US009825373B1

(12) United States Patent
Smith

(10) Patent No.: US 9,825,373 B1
(45) Date of Patent: Nov. 21, 2017

(54) MONOPATCH ANTENNA

(71) Applicant: Exelis Inc., Herndon, VA (US)

(72) Inventor: Richard Sharp Smith, Triangle, VA (US)

(73) Assignee: Harris Corporation, Melbourne, FL (US)

( * ) Notice: Subject to any disclaimer, the term of this patent is extended or adjusted under 35 U.S.C. 154(b) by 72 days.

(21) Appl. No.: 14/854,630

(22) Filed: Sep. 15, 2015

(51) Int. Cl.

| | |
|---|---|
| ***H01Q 21/29*** | (2006.01) |
| ***H01Q 21/24*** | (2006.01) |
| ***H01Q 21/00*** | (2006.01) |
| ***H01Q 1/48*** | (2006.01) |
| ***H01Q 9/04*** | (2006.01) |
| ***H01Q 21/28*** | (2006.01) |

(52) U.S. Cl.
CPC ..... *H01Q 21/24* (2013.01); *H01Q 1/48* (2013.01); *H01Q 9/045* (2013.01); *H01Q 9/0428* (2013.01); *H01Q 21/0006* (2013.01); *H01Q 21/28* (2013.01)

(58) Field of Classification Search
CPC ..... H01Q 21/24; H01Q 21/28; H01Q 21/29
See application file for complete search history.

(56) References Cited

U.S. PATENT DOCUMENTS

| | | | | |
|---|---|---|---|---|
| 5,300,936 A * | 4/1994 | Izadian | H01Q 1/32 343/700 MS |
| 6,160,512 A * | 12/2000 | Desclos | H01Q 1/242 343/700 MS |
| 6,313,801 B1 | 11/2001 | Sanford et al. | |
| 6,909,400 B2 | 6/2005 | Vothknecht et al. | |
| 7,091,917 B2 * | 8/2006 | Jan | H01Q 9/0464 343/700 MS |

OTHER PUBLICATIONS

Kuga, N., "Feeding Condition of Patch-Monopole Composite Antenna with Horizontal Broad Beam", Microwave Conference, Proceedings of APMC 2001, Taipei, Taiwan, vol. 3: 1358-1361 (2001).

* cited by examiner

*Primary Examiner* — Hoang Nguyen
(74) *Attorney, Agent, or Firm* — Edell, Shapiro & Finnan LLC

(57) ABSTRACT

A monopatch antenna system includes a ground plane, a patch antenna arranged parallel to the ground plane and having an aperture, and a monopole antenna extending perpendicularly to the ground plane through the aperture in the patch antenna. A feed system supplies a first portion of an RF signal to the patch antenna with a substantially circular polarization and simultaneously supplies a second portion of the RF signal to the monopole antenna with a linear polarization to produce a wide-beam composite antenna beam pattern having both linear and circular polarizations of the RF signal.

20 Claims, 5 Drawing Sheets

MONOPATCH ANTENNA

GOVERNMENT INTERESTS

The U.S. Government may have a paid-up license in this invention and the right in limited circumstances to require the patent owner to license others on reasonable terms as provided for by the terms of contract No. W911QX-10-D-0005.

BACKGROUND

Both patch or "microstrip" antennas and monopole antennas are well established in the art. Patch antennas typically provide antenna beam patterns with a peak gain in a direction perpendicular to the plane of the patch, but have increasingly lower gain in directions at increasing angles to this perpendicular direction, resulting in an antenna beam pattern with a generally teardrop shape when depicted in three dimensions. Monopole antennas provide antenna beam patterns having a peak gain in directions between a line through their axes and those perpendicular to this axial direction, which when depicted in three dimensions appears somewhat toroidal.

Combining a patch antenna with a monopole antenna to produce a composite antenna beam pattern has been proposed in a specific context using exclusively linear polarization in both antennas. According to the proposed design, a monopole antenna extending perpendicularly along a z axis from a ground plane lying in an x-y plane is excited by a single, center feed to produce an antenna beam having polarization in the x direction, which, with z in the upward direction, constitutes horizontal polarization. A patch antenna lying in an x-y plane above the ground plane is excited by a single feed, off-center in the x-y plane (along the y axis). The objective of this specific configuration is to produce a broad-beam antenna pattern that exclusively exhibits a horizontal polarization in the y-z plane of interest. This design was proposed for use in an array of antennas deployed in a cellular communication base-station (cell tower) where horizontal polarization optimized in a single plane was believed to be useful.

Further, patch antennas having circular polarization are known. However, circular polarization is generally undesirable in applications where a particular linear polarization is desired, such as in the aforementioned antenna system, because circular polarization distributes half of the radio frequency (RF) energy in a perpendicular horizontal polarization, generally making signal detection more difficult in each of the linear polarizations. Thus, introduction of circular polarization in the aforementioned system optimized for horizontal polarization in a particular plane would result in poorer performance.

SUMMARY

The described "monopatch" antenna system comprises a ground plane, a patch antenna arranged parallel to the ground plane, a monopole antenna extending perpendicularly to the ground plane through an aperture in the patch antenna, and a feed system configured to supply a first portion of an RF signal to the monopole antenna with a linear polarization (perpendicular to the direction of propagation and in a plane containing the z axis) and to simultaneously supply a second portion of the RF signal to the patch antenna with a substantially circular polarization to produce a composite antenna beam pattern comprising both linear and circular polarizations of the RF signal. Owing to the different polarizations of the two antennas, the composite antenna beam pattern of the antenna system has a substantially circular polarization in a propagation direction perpendicular to the ground plane and has a decreasingly circular polarization and an increasingly linear polarization in propagation directions with increasing angles to the perpendicular direction. The circular polarization consists of a rotating radiated electric field in a plane perpendicular to the direction of propagation. This propagation direction is always along a line away from the origin (point on the ground plane under the center of the patch). Thus, the rotating e-field (circular polarization) is in the plane of the patch for propagation perpendicular to the ground plane, where the gain (and the magnitude of the fields) is maximum, but is not perpendicular to the ground plane for propagation in other directions.

In certain contexts, this combination of linear and circular polarizations provides unique and unexpected advantages. For example, in a look-down, aircraft-mounted antenna, the objective is to be able to communicate with as many wireless devices (targets) as possible around and underneath an aircraft. The antennas of ground targets most often have vertical polarization, which would suggest that a monopatch antenna should be designed with linear, vertical polarization. However, in practice, when a ground target is directly underneath an aircraft (in the null of the monopole antenna pattern), where it is impossible to produce vertical polarization, experimental testing revealed that circular polarization worked better than linear polarization to link with these targets. Moreover, since these look-down targets are physically closest to the aircraft, the loss of power in each of the linear polarizations is less significant for detection.

For ground targets that are further away from the aircraft (and therefore at greater angles relative to the monopole antenna axis) and require relatively more RF energy, more of the RF energy is transmitted and received in the linear, vertical polarization resulting from the antenna beam pattern of the vertically polarized monopole antenna and less from the circularly polarized patch antenna. Thus, the combination of a circularly polarized patch antenna and a linearly polarized monopole antenna unexpectedly results in an ideal combination to produce a composite broad-beam antenna pattern in this and other contexts.

In an example implementation, the feed system includes a directional coupler configured to split the RF signal into the first and second portions, a monopole feed configured to couple the first portion of the RF signal to the monopole antenna, a 90° hybrid configured to split the second portion of the RF signal into first and second patch signals offset in phase by 90°, and first and second patch feeds configured to respectively couple the first and second patch signals to the patch antenna to produce the substantially circular polarization. According to another implementation, instead of a 90° hybrid, a zero-degree splitter with an added 90° delay to the transmission line to one of the patch feeds could be used to drive the patch antenna.

According to one option, to increase the bandwidth of the patch antenna, a parasitic patch is arranged parallel to the ground plane such that the patch antenna is disposed between the parasitic patch and the ground plane. According to another option, to achieve dual-band operation, a second patch antenna is arranged parallel to the ground plane such that the patch antenna is disposed between the second patch antenna and the ground plane. The feed system supplies an RF signal having energy in first and second frequency bands to the antennas to produce a composite antenna beam pattern comprising both linear and circular polarizations of the dual-band RF signal.

The above and still further features and advantages of the described system will become apparent upon consideration of the following definitions, descriptions and descriptive figures of specific embodiments thereof wherein like reference numerals in the various figures are utilized to designate like components. While these descriptions go into specific details, it should be understood that variations may and do exist and would be apparent to those skilled in the art based on the descriptions herein.

DETAILED DESCRIPTION

Figure 1:
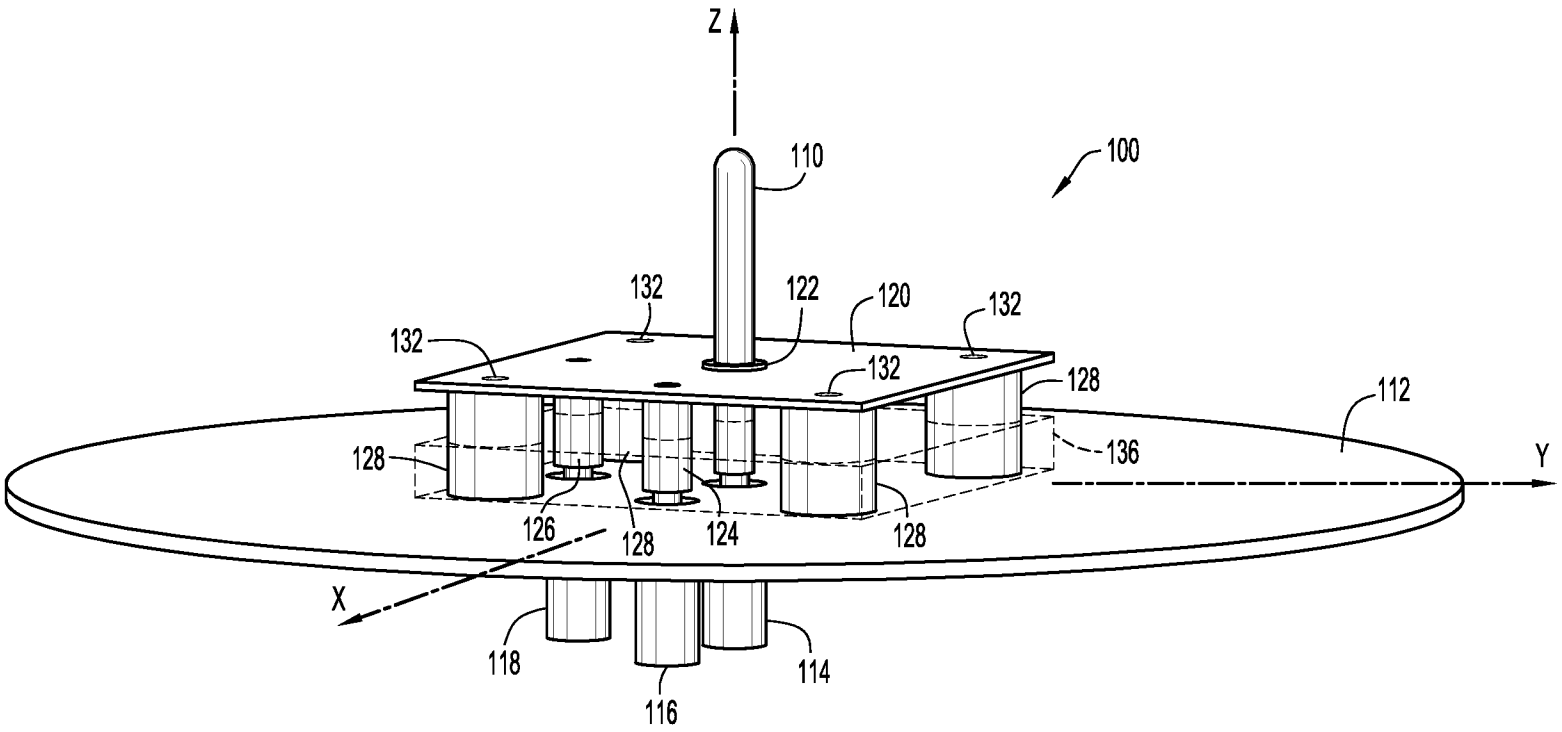
FIG. 1 is a perspective view of an example implementation of a single-band monopatch antenna.

The monopatch antenna system described herein employs the combination of a patch antenna and a monopole antenna, but unlike previously proposed systems, the described monopatch antenna system drives the patch antenna with a substantially circularly polarized RF signal, e.g., by employing two, 90°-hybrid-driven patch feeds. Rather than producing an antenna beam pattern designed to provide horizontal polarization in a single plane (suggested as useful in the limited context of a cell tower antenna array), the disclosed monopatch antenna provides a nearly hemispherical antenna beam pattern that is substantially symmetrical in all azimuth directions about an axis perpendicular to the ground plane (i.e., the monopole axis) and provides a novel mixture of polarizations that has wide applicability in a number of applications.

Specifically, the disclosed monopatch antenna system provides a significant improvement over previously proposed antenna systems in that it can produce near-hemispherical antenna beam patterns together with polarizations that can excite antennas within that pattern that have a wide variety of polarizations and are in a wide variety of orientations. In particular, the disclosed antenna system produces a near-ideal pattern with near-ideal polarization for down-looking aircraft antennas linking to antennas with primarily vertical polarization. The antenna beam pattern and polarization are also nearly ideal when looking upward for many satellite communication (SATCOM) applications.

A unique and unexpected advantage of the monopatch antenna described herein is that the circularly-polarized patch antenna provides a substantially enhanced ability to communicate with remote antennas having polarization along the line between the two antennas (such as a vertical whip antenna directly beneath a monopatch antenna system mounted to the bottom surface of an aircraft). This direction corresponds to the null in the monopole antenna pattern and is where the polarization of the patch radiation is perpendicular to that required by the remote antenna. The advantage is realized because, with circular polarization, there are polarization components in all directions perpendicular to the line between the antennas. When such components reflect from objects near the remote antenna, a component of the reflected radiation will have the polarization needed by the remote antenna. Since, in many cases, this is also the direction in which remote antennas are the closest to the monopatch antenna system (the aforementioned aircraft case being an example), the reflected radiation, though considerably reduced in intensity from the direct radiation, is often still sufficient to successfully make a communication link.

Note that if a second patch feed were added to the previously proposed system in the most straightforward manner, i.e., using a simple, zero-degree, 1×2 splitter/combiner, the resulting pattern and polarization would be much the same as that of original system (entirely linear polarization), but simply rotated 45° about the monopole axis. The monopatch system described herein is the first instance of using two patch feeds at 90° phase to achieve a result other than pure circular polarization. On the other hand, this feed arrangement also makes the radiation partially circularly polarized, which has advantages in, for example, SATCOM applications and airborne contexts, as previously described. That adding an element of circular polarization would substantially enhance links to linearly-polarized antennas was previously not appreciated.

Figure 2:
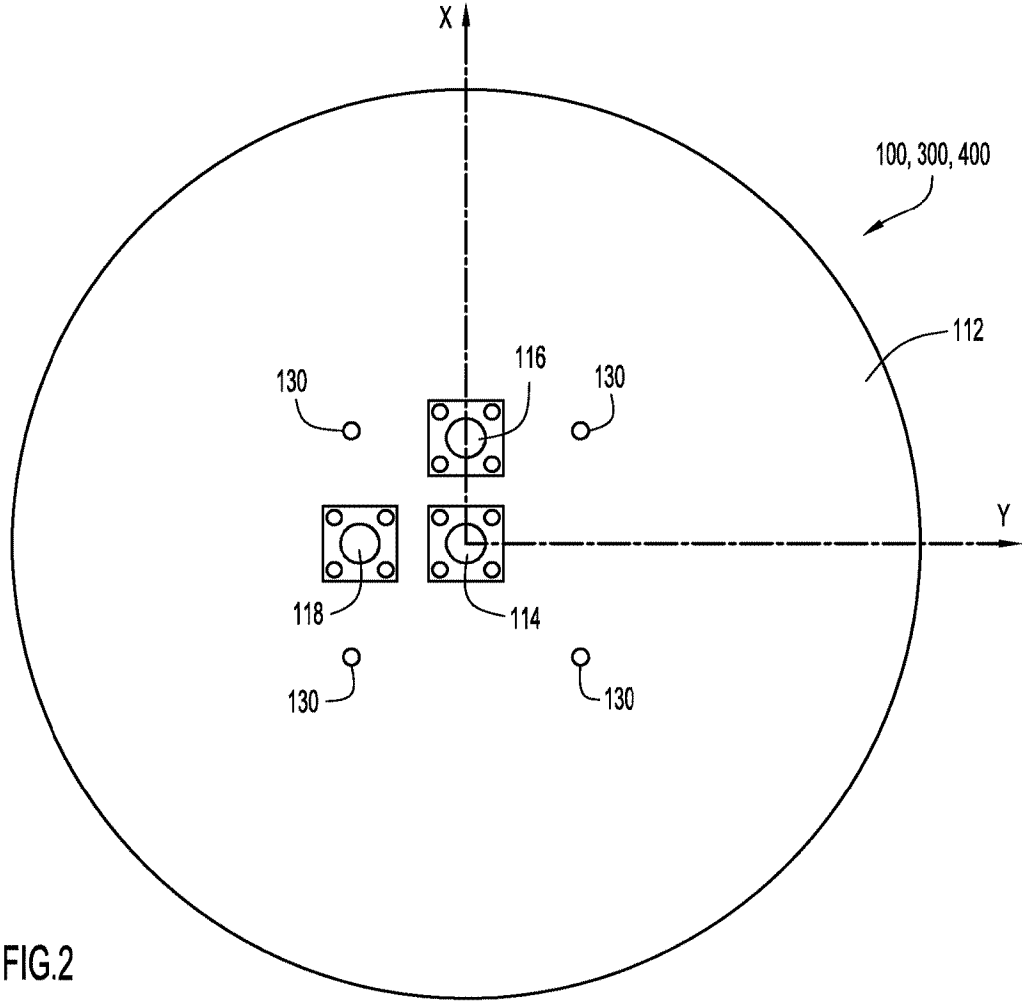
FIG. 2 is a plan view of the backside of the ground plane of the monopatch antenna implementations shown in FIGS. 1, 3, and 4.

An embodiment of an antenna system 100 using a single patch is shown in FIGS. 1 and 2 relative to a three-dimensional Cartesian coordinate system defined by x, y, and z axes that are pairwise perpendicular. In particular, FIG. 1 is a perspective view of antenna system 100, and FIG. 2 is bottom plan view of antenna system 100. The representation in FIG. 2 is also applicable to the embodiments shown in FIG. 3 (parasitic stacked patch) and FIG. 4 (dual-band stacked patch).

In FIG. 1, a substantially rod-shaped monopole antenna 110 extends perpendicularly along the positive z axis from the center of one side (e.g., a front side) of a circular ground plane 112 lying along a plane defined by the x axis and the y axis (i.e., the geometric center of ground plane 112 is positioned at the origin of the x-y plane). Monopole antenna 110 is fed by a first, centrally located coaxial connector 114 that extends from the center of an opposite side (e.g., a back side) of ground plane 112 in the negative z direction. In particular, the center conductor of first coaxial connector 114 extends through a center opening in ground plane 112 from the back side to the front side and is coupled to the bottom end of monopole antenna 110 (i.e., the end adjacent to ground plane 112), and the outer shield of first coaxial connector 114 is coupled to ground plane 112.

According to another option, a monoconic antenna (conical-shaped, with the larger end at the top) or a top-loaded monopole antenna (e.g., with a round plate at the top) can be employed instead of a conventional rod-shaped monopole antenna to allow a shorter monopole and/or a greater bandwidth. Thus, as used herein and in the claims, the term monopole antenna encompasses rod-shaped antenna structures as well as other monopole-like antenna structures that produce similar antenna beam patterns, including monoconic and monopole antennas with loading structures.

As described below in connection with the antenna feed network shown in FIG. 5, first coaxial connector 114 supplies radio frequency (RF) energy to monopole antenna 110 from an RF source (e.g., a transmitter) and supplies RF energy received by monopole antenna 110 to an RF receiver. This feed arrangement results in monopole antenna 110 having a transmit/receive antenna beam pattern with a linear polarization. The antenna beam pattern of monopole antenna 110 is somewhat toroid-shaped. More specifically, using the convention that angles of azimuth represent directions in the x-y plane and angles of elevation represent angles relative to the z axis (i.e., directions in the x-y plane have an elevation of 90° and the z axis has an elevation of 0°), the antenna beam pattern of monopole antenna 110 has a roughly constant gain in all azimuth directions, with a maximum gain at an elevation angle somewhat above the x-y plane and diminishing gain at decreasing elevation angles (towards the z axis), with a null in the direction of the monopole (z) axis.

A second coaxial connector 116 extends from the back side of ground plane 112 from a position that is offset from first coaxial connector 114 in the x direction (along the x-axis), as best shown in the back side plan view of FIG. 2. A third coaxial connector 18 extends from the back side of ground plane 112 from a position that is offset from first coaxial connector 114 in they direction (along the negative y axis), such that second and third coaxial connectors 116 and 118 are off-center and are positioned along perpendicular axes relative to the center of ground plane 112. The outer conductors of second and third coaxial connectors 116 and 118 are coupled to ground plane 112.

A substantially planar, square or rectangular patch antenna 120 is disposed parallel to the x-y plane in the positive z direction, i.e., parallel to ground plane 112, and is centered relative to the z axis. While rectangular patch antennas are depicted in the figures for convenience, it will be appreciated that the patch antenna can be designed with any suitable shape (e.g., round) and the monopatch antenna described herein is not limited to square or rectangular-shaped patch antennas. Thus, as used herein, the term patch antenna encompasses a wide range of generally flat, sheet-like or patch-like microstrip antennas having a directional antenna beam pattern. Patch antenna 120 includes a geometrically centered aperture (hole) though which monopole antenna 110 extends. A dielectric bushing 122 centers monopole antenna 110 in the center aperture of patch antenna 120. Patch antenna 120 is fed by first and second probes 124 and 126, which are respectively driven by second and third coaxial connectors 116 and 118. More specifically, first probe 124 extends in the z direction between ground plane 112 and patch antenna 120 and is axially aligned in the z direction with second coaxial connector 116, i.e., first probe 124 is offset from the center of ground plane 112 along the x axis. One end of first probe 124 is coupled to the center conductor of second coaxial connector 116 and the other end of first probe 124 is coupled to patch antenna 120 at a point offset from its center along the x axis. Similarly, second probe 126 extends in the z direction between ground plane 112 and patch antenna 120 and is axially aligned in the z direction with third coaxial connector 118, i.e., second probe 126 is offset from the center of ground plane 112 along the negative y axis. One end of second probe 126 is coupled to the center conductor of third coaxial connector 118 and the other end of second probe 126 is coupled to patch antenna 120 at a point offset from its center along the negative y axis.

Patch antenna 120 is supported by four dielectric (e.g., Rexolite) standoffs 128 that extend in the z direction between ground plane 112 and patch antenna 120 near the four corners of patch antenna 120. Four corresponding holes 130 in ground plane 112 and four corresponding holes 132 in patch antenna receive dielectric (e.g., nylon) fasteners (not shown) to fasten patch antenna 120 to ground plane 112. Standoffs 128 have corresponding holes through their centers for this same purpose. Ground plane 112 can be, for example, the ground plane of a circuit board, in which case the center conductors of coaxial connectors 114, 116, and 118 are implemented as pins in vias, the via pads of which are driven via circuit-board transmission lines from RF sources. While a round ground plane is depicted in the figures, the ground plane can be any size or shape. For example, the ground plane can be implemented using the metal underside of an aircraft, or the ground plane can be a component of an antenna structure but RF-coupled to a larger ground plane such as the underside of an aircraft or a large panel of a platform on which the antenna is mounted.

According to one option, the volume in the space between ground plane 112 and patch antenna 120, i.e., surrounding standoffs 128, probes 124 and 126, and the lower portion of monopole antenna 110, can be partially filled with a dielectric material (e.g., plastic) 136 having a suitable dielectric constant that loads patch antenna 120, allowing the dimensions of patch antenna 120 to be reduced relative to the dimensions that would otherwise be required to be resonant at a particular wavelength. As shown in FIG. 1, for example, dielectric material 136 can fill a box-shaped region (parallelepiped) extending in the z direction from the front surface of ground plane 112 to a point below patch antenna 120, and having a substantially square cross-sectional profile in the x-y plane, corresponding to the dimensions of patch antenna 120. Dielectric material 136 is shown with dashed lines in FIG. 1 to represent that it is optional and to avoid obscuring the other features depicted. The remaining portion of the region between ground plane 112 and patch antenna 120 can be air-filled, e.g., an air gap.

While the dielectric material 136 shown in FIG. 1 extends from ground plane 120 to a point between ground plane 120 and patch antenna 120, according to another option, dielectric material can extend from both ground plane 112 and patch antenna 120, leaving an air-filled region between the two dielectric regions. According to a further option, the dielectric material can extend from patch antenna 120 rather than from ground plane 112. According to yet anther option, the dielectric material can extend vertically from ground plane 112 to patch antenna 120 along the periphery of patch antenna 120, leaving an interior region between ground plane 112 and patch antenna air-filled, such that air-filled middle region is surrounded by a dielectric-filled outer region.

According to another option, the volume in the space between ground plane 112 and patch antenna 120 can be completely filled with a dielectric material. According to yet another option, the volume in the space between ground plane 112 and patch antenna 120, i.e., surrounding standoffs 128, probes 124 and 126, and the lower portion of monopole antenna 110, can be can be substantially empty (i.e., filled with air).

As described below in connection with the antenna feed network shown in FIG. 5, second and third coaxial connectors 116 and 118 supply RF energy to patch antenna 120 via probes 124 and 126 from the RF source (transmitter, not shown) and supply RF energy received by patch antenna 120 to the RF receiver (not shown). This feed arrangement results in patch antenna 120 having a transmit/receive antenna beam pattern with a substantially circular polarization. The antenna beam pattern of patch antenna 120 is somewhat balloon-shaped or teardrop-shaped, with a highest gain in the direction of the positive z axis (elevation angle of 0°) and a diminishing gain at increasingly greater elevation angles and with a roughly constant gain in all azimuth directions.

In FIG. 1, ground plane 112, monopole antenna 110, and patch antenna 120 have suitable shapes, dimensions, conductive materials, and spacings between the patch and ground plane to radiate and receive RF energy at substantially the same frequencies or significantly overlapping frequencies such that a composite antenna beam pattern results from the two antennas over at least one frequency band simultaneously. By way of a non-limiting example, ground plane 112 can have a diameter of approximately 6 inches, the sides of patch antenna 120 can be approximately 2 inches long, and monopole antenna can have a length on the order of 1.5 inches, resulting in a monopatch antenna capable of operating at S-band (e.g., approximately 2,200 MHz). Thus, the area of ground plane 112 in this example is much larger than the area of patch antenna 120 (at least 5 or 6 times larger), and in general is preferably at least two or three times larger than the area of patch antenna 120.

Figure 3:
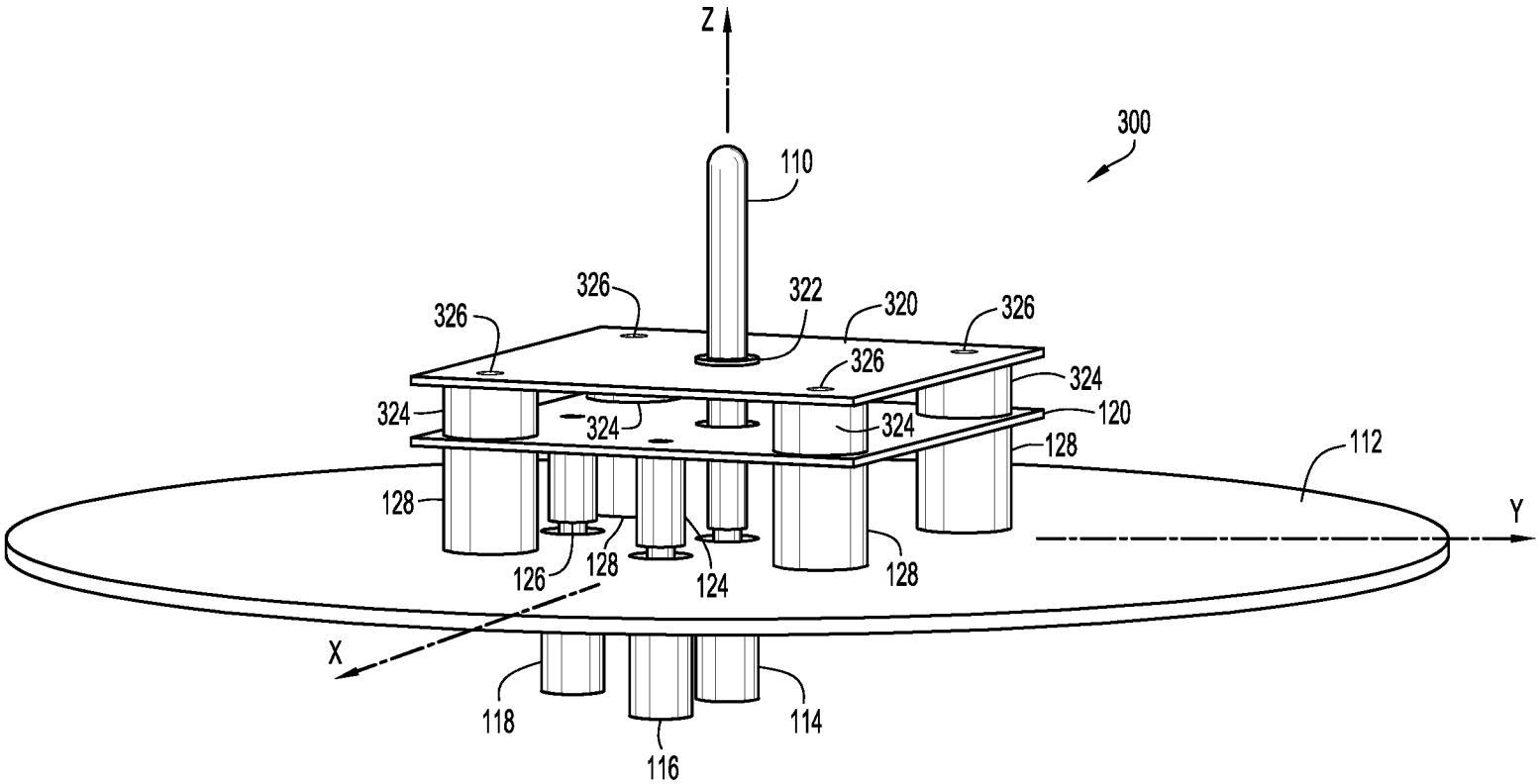
FIG. 3 is a perspective view of a modification of the implementation shown in FIG. 1 involving an additional patch providing a parasitic-stacked-patch design having a broader bandwidth.

FIG. 3 illustrates an antenna system 300 using a parasitic-stacked-patch arrangement, which is essentially an enhancement to antenna system 100 shown in FIGS. 1 and 2 involving the addition of a parasitic patch. Specifically, a substantially square or rectangular parasitic patch 320 is disposed parallel to the x-y plane in the positive z direction, i.e., parallel to and above patch antenna 120, and is centered relative to the z axis such that patch antenna 120 lies between ground plane 112 and parasitic patch 320. As with the previous example, the patches can have other shapes, such as round. The dimensions of parasitic patch 320 and its distance from patch 120 and ground plane 112 are optimized to provide the greatest bandwidth, resulting in dimensions that typically are close to, but different from, the dimensions of patch antenna 120. Parasitic patch 320 includes a geometrically centered aperture though which monopole antenna 110 extends. A dielectric bushing 322 centers monopole antenna 110 in the center aperture of parasitic patch 320 (in this case, dielectric bushing 122 in the center aperture of patch antenna 120 can be omitted, though neither patch can touch monopole antenna 110 or be close enough to be too strongly capacitively coupled to monopole antenna 110).

Parasitic patch 320 is spaced apart from patch antenna 120 and supported by four dielectric standoffs 324 that extend in the z direction between patch antenna 120 and parasitic patch 320 near the four corners of parasitic patch 320. Four corresponding holes 326 in parasitic patch 320 receive dielectric (e.g., nylon) fasteners (not shown) to fasten parasitic patch 320 to patch antenna 120. Standoffs 324 have corresponding holes through their centers for this same purpose. Though not directly fed by second and third coaxial conductors 116 and 118 which feed patch antenna 120, parasitic patch 320 provides antenna system 300 with a greater bandwidth than a comparable antenna system 100 without a parasitic patch. For example, while still operating at S-band, the parasitic-stack-patch implementation may result in a useful bandwidth spanning 2,300-2,500 MHz.

For ease of illustration, dielectric material 136 shown in FIG. 1 has been omitted in FIG. 3, but it will be understood that the volume between ground plane 112 and patch antenna 120 (surrounding standoffs 128, probes 124 and 126, and the lower portion of monopole antenna 110) can be filled with a dielectric material (e.g., plastic), partially filled with a dielectric material and partially air-filled, or just an air gap (not filled at all with a dielectric material). Similarly, the volume of space between patch antenna 120 and parasitic patch 320 (surrounding standoffs 324 and the middle portion of monopole antenna 110) can be filled with a dielectric material, partially filled with a dielectric material (partially air-filled), or only an air gap.

Figure 4:
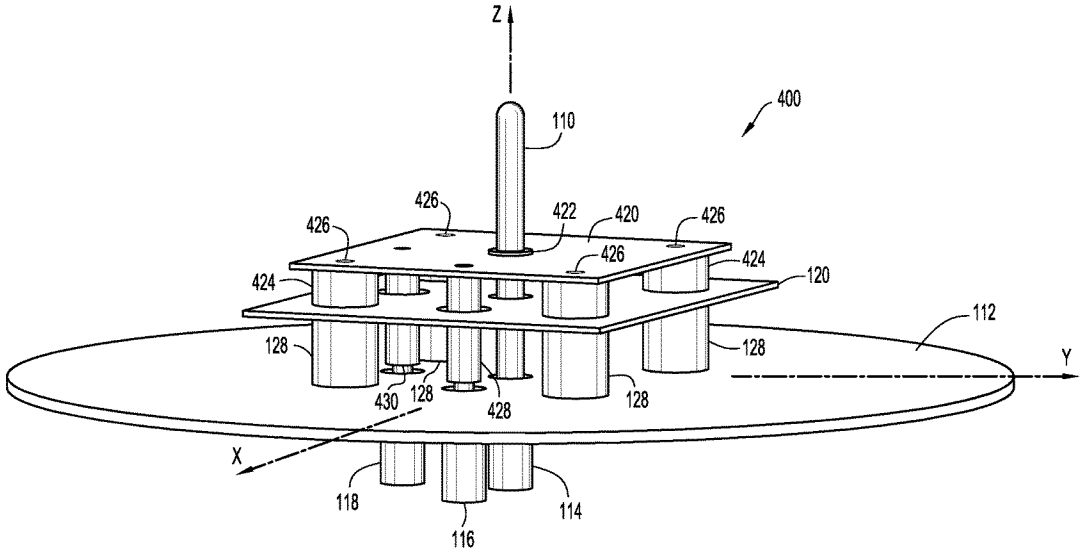
FIG. 4 is a perspective view of a modification of the implementation shown in FIG. 1 involving an additional patch providing a stacked, dual-band design that operates at two frequency bands.

FIG. 4 illustrates a two-band stacked antenna system 400, which is essentially an enhancement to antenna system 100 shown in FIGS. 1 and 2 involving the addition of a second patch antenna 420. Specifically, a substantially square or rectangular second patch antenna 420 is disposed parallel to the x-y plane in the positive z direction, i.e., parallel to the first patch antenna 120, and is centered relative to the z axis such that first patch antenna 120 lies between ground plane 112 and second patch antenna 420. Second patch antenna 420 includes a geometrically centered aperture though which monopole antenna 110 extends. A dielectric bushing 422 centers monopole antenna 110 in the center aperture of second patch antenna 420 (in this case, dielectric bushing 122 in the center aperture of patch antenna 120 can be omitted). As with the previous examples, the patch antenna can have other suitable shapes, such as round.

First and second patch antennas 120 and 420 can have dimensions and heights suitable for transmitting and receiving RF energy at two respective frequency bands. For example, for two frequency bands that are relatively closely spaced in the RF spectrum, first and second patch antennas 120 and 420 can be half-wave patches having similar dimensions. For two frequency bands that are further apart in the RF spectrum, first and second patch antennas 120 and 420 can have significantly different dimensions, since the resonant frequency of an antenna structure is generally approximately proportional to the current path lengths of the antenna conductor. In the example shown in FIG. 4, second patch antenna 420 is somewhat smaller than patch antenna 120, reflecting its higher operating frequency.

Second patch antenna 420 is spaced apart from first patch antenna 120 and supported by four dielectric standoffs 424 that extend in the z direction between first patch antenna 120 and second patch antenna 420 near the four corners of second patch antenna 420. Four corresponding holes 426 in second patch antenna 420 receive dielectric (e.g., nylon) fasteners (not shown) to fasten second patch antenna 420 to patch antenna 120. Standoffs 424 have corresponding holes through their centers for this same purpose.

Antenna system 400 shown in FIG. 4 differs from antenna system 300 shown in FIG. 3 in that second patch antenna 420 of antenna system 400 is directly fed by second and third coaxial connectors 116 and 118, whereas parasitic patch 320 in antenna system 300 is not. In particular, a first probe 428 extends in the z direction, through an aperture in first patch antenna 120, between ground plane 112 and second patch antenna 420 and is axially aligned in the z direction with second coaxial connector 116, i.e., first probe 428 is offset from the center of ground plane 112 along the x axis. The diameters of the apertures in first patch 120 are larger than those of probes 428 and 430. Probes 428 and 430 thus do not contact first patch 120, but are capacitively coupled to it. The clearance between first patch 120 and the probes is chosen so as to provide the desired frequency, bandwidth, and/or impedance. First probe 428 is coupled to the center conductor of second coaxial connector 116 and to first and second patch antennas 120 and 420 at points offset from their center along the x axis.

Similarly, a second probe 430 extends in the z direction, through an aperture in first patch antenna 120, between ground plane 112 and second patch antenna 420 and is axially aligned in the z direction with third coaxial connector 118, i.e., second probe 430 is offset from the center of ground plane 112 along the negative y axis. Second probe 430 is coupled to the center conductor of third coaxial connector 118 and to first and second patch antennas 120 and 420 at points offset from their center along the negative y axis. Each of probes 428 and 430 supplies RF energy in two frequency bands, and each of first and second patch antennas 120 and 420 is shaped, dimensioned, and positioned relative to the ground plane and each other to efficiently operate (e.g., resonate) at one of the two frequency bands, resulting in two-band operation.

For ease of illustration, dielectric material 136 shown in FIG. 1 has been omitted in FIG. 4, but it will be understood that the volume between ground plane 112 and patch antenna 120 (surrounding standoffs 128, the lower portions of probes 428 and 430, and the lower portion of monopole antenna 110) can be filled with a dielectric material (e.g., plastic), partially filled with a dielectric material (and partially air-filled), or just an air gap (not filled at all with a dielectric material). Similarly, the volume of space between patch antenna 120 and patch antenna 420 (surrounding standoffs 424, the upper portions of probes 428 and 430, and the middle portion of monopole antenna 110) can be filled with a dielectric material, partially filled with a dielectric material (partly an air gap), or only an air gap.

Monopole antenna 110 shown in FIG. 4 is also configured to operate in the same two frequency bands as patch antennas 120 and 420. According to one option, monopole antenna operates over a broad band that encompasses the two operating frequency bands. This configuration is particularly suitable where the two frequency bands of interest are relatively close together. By way of a non-limiting example, patch antenna 120 can operate at L-band (e.g., approximately 1,800 MHz), patch antenna 420 can operate at S-band (e.g., approximately 2,200 MHz), and monopole antenna can operate at both S-band and L-band. According to another option, any of a variety of known mechanisms can be used to cause monopole antenna 110 to operate at two frequency bands corresponding to the frequency bands of patch antennas 120 and 420 such that a composite antenna beam pattern results from the patch and monopole antennas over at least two frequency bands simultaneously.

While the embodiments shown in FIGS. 1-4 involve a circular ground plane and square or rectangular patches, these configurations are shown for illustrative purposes, and any of a variety of shapes and sizes of the ground plane, the patches, and the monopole antenna, as well as relative spacings and dielectrics can be employed to achieve desired operation at certain wavelengths/frequencies or antenna beam patterns. For example, as previously explained, the various patch structures can be round.

Figure 5:
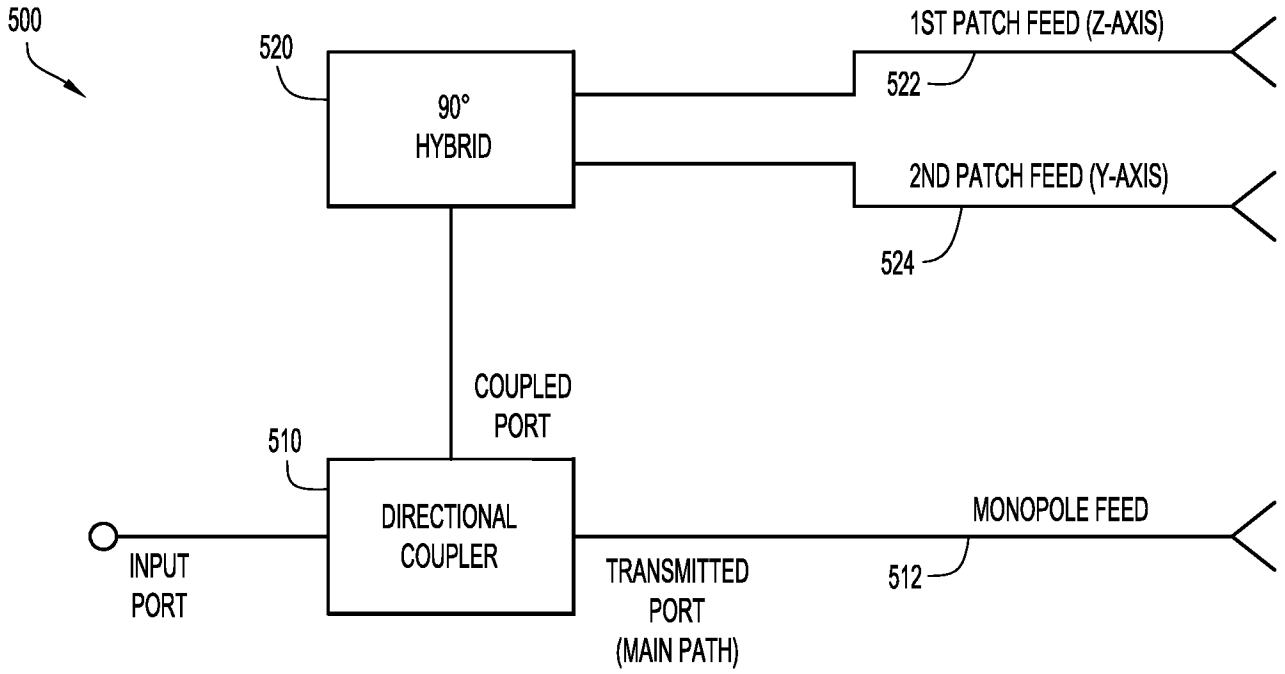
FIG. 5 is a block diagram of an example implementation of an RF antenna feed system for the implementations shown in FIGS. 1-4.

FIG. 5 is a block diagram of an example antenna feed system 500 that can be used with the antenna systems shown in FIGS. 1-4. Feed system 500 is designed to supply a first portion of an RF signal to the monopole antenna with a linear polarization and to simultaneously supply a second portion of the RF signal to the patch antenna with a substantially circular polarization to produce a composite antenna beam pattern comprising both linear and circular polarizations of the RF signal. In particular, the composite antenna beam pattern has a substantially circular polarization in a propagation direction perpendicular to the ground plane, owing to the polarization of the patch antenna, which has its peak gain in that direction (the linear polarization of the monopole antenna provides minimal contribution in this direction due to the null in its antenna beam pattern). For propagation directions at elevations angles ranging from the perpendicular direction (the monopole z axis) to angles somewhat above the ground plane, the composite beam pattern has a decreasingly circular polarization and an increasingly linear polarization, owing to the decreasing gain of the patch antenna and the increasing gain of the monopole antenna.

Antenna feed system 500 includes a directional coupler 510 having an input port, a coupled port, and a transmitted port. When used in transmission, directional coupler 510 splits an RF signal received at the input port and supplies a first portion of the RF signal to the transmitted port and a second portion of the RF signal to the coupled port. By way of a non-limiting example, directional coupler 510 can have a coupling factor of 5 dB, 6 dB, or 10 dB, meaning than the input signal is split such that the power of the signal at the transmitted port is 5, 6, or 10 dB greater than the power of the signal at the coupled port. When used in reception, directional coupler 510 operates in reverse by combining signals from the transmitted and coupled ports, according to the same power ratio, into a composite signal at the input port.

Referring again to FIG. 5, the transmitted port of directional coupler 510 is coupled to a monopole feed 512 (e.g., including first coaxial connector 114) that supplies the first portion of the RF signal to the monopole antenna via a main path, resulting in a linear polarization (perpendicular to the direction of propagation and in a plane containing the z axis) of the first portion of the RF signal.

The coupled port of directional coupler 510 supplies the second portion of the RF signal along a coupled path to an input of a 90° hybrid 520, which divides the power of the second portion of the RF signal substantially equally between first and second patch signals, with the phase of the power of one of the patch signals being delayed by substantially 90° relative to the phase of the power to the other patch signal. One output of 90° hybrid 520 supplies the first patch signal to a first (x axis) patch feed 522 (e.g., including second coaxial connector 116), and another output of 90° hybrid 520 supplies the second patch signal to a second (y axis) patch feed 524 (e.g., including third coaxial connector 118), resulting in a substantially circular polarization of the second portion of the RF signal supplied to patch antenna 120. In general, feed system 500 can be implemented with connectorized components interconnected using coaxial cables, with surface mounted technology (SMT) components mounted on a circuit board interconnected using microstrip lines or strip lines, with components fabricated directly on the circuit board, or with components fabricated by any other means or combinations of such technologies, which provide the required portions of RF energy to the patch antenna and the monopole antenna with the required phase relationships.

The antenna system described in connection with FIGS. 1-5 operates in the following manner. Patch antenna 120, parasitic patch 320, and second patch antenna 420 can be half-wave patches, having maximum RF voltages at their edges and near zero voltage at their centers, where the monopole antenna is located. This configuration enables the monopole antenna and the patches to be highly independent, i.e., to have low mutual coupling. As previously explained, the monopole antenna provides the bulk of its radiation in directions at a substantial angle to its axis, whereas the peak radiation of the patches is along the direction of the monopole axis on the front (antenna) side of the ground plane. Thus, by careful choice of the ratio of power to the monopole antenna relative to the power to the patch(es), and in some cases the relative phase, a near-hemispherical antenna beam pattern can be obtained. The amount of power feeding the patches relative to that feeding the monopole is controlled by the coupling ratio of directional coupler 510. The relative phases of the RF signals can be controlled by the relative lengths of the transmission lines of feed system 500. 90° hybrid 520 divides the power to the patch(es) equally between the two patch feeds with the phase of the power to one patch feed delayed 90° relative to the phase of the power to the other patch feed. In contrast to a monopatch antenna system with a single feed, or one in which the two feeds are driven by a common, zero-degree, two-way splitter/combiner, the use of the 90° hybrid enables the radiation pattern to be very nearly symmetric about the monopole axis.

This described antenna system is useful in any application requiring a near-hemispherical radiation pattern. The antenna system is especially applicable where it can be mounted to the underside of an aircraft, looking downward, where it is desired to illuminate wide regions both directly underneath the aircraft when airborne and up to considerable distances below the aircraft fore, aft, and to the sides of the aircraft, and where the polarization of remote antennas needing to accept this radiation is either linear or circular of the type primarily produced by the patches, and where the orientation of these remote antennas is random. Other important applications include satellite communication (SATCOM) applications, such as global position system (GPS), Iridium, and Globalstar, where the antenna is oriented upward. In addition to the nearly-hemispherical pattern (much more nearly hemispherical than a patch alone or helical SATCOM antennas), which will allow links to satellites in any part of the sky, the antenna radiation can be made partially circularly polarized, of the type accepted by the satellites, by virtue of the two, 90°-hybrid-driven patch feeds while still have significant radiation at angles close to the horizontal—the mean elevation positions of many SATCOM satellites. Inasmuch as linear polarization consists of equal parts of each type of circular polarization, the satellites will also respond to the linear polarization of these antennas, albeit at with approximately 3-dB less link margin.

Having described example embodiments of a monopatch antenna, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An antenna system comprising:

a ground plane;

a patch antenna arranged parallel to the ground plane and having an aperture;

a monopole antenna extending perpendicularly to the ground plane through the aperture in the patch antenna; and a feed system configured to receive at an input port a radio frequency (RF) signal at a first frequency and to supply a first portion of the RF signal to the monopole antenna with a linear polarization and to simultaneously supply a second portion of the RF signal to the patch antenna with a substantially circular polarization to produce a composite antenna beam pattern comprising both linear and circular polarizations of the RF signal at the first frequency.

2. The antenna system of claim 1, wherein the feed system is configured to supply the first portion of the RF signal to the monopole antenna with a vertical polarization.

3. The antenna system of claim 1, wherein the feed system is configured to:

receive RF signals from the patch antenna with a substantially circular polarization and from the monopole antenna with a linear polarization; and combine the RF signals received from the patch antenna and the monopole antenna into a composite received signal.

4. The antenna system of claim 1, further comprising:

a dielectric material disposed between the ground plane and the patch antenna such that a space between the ground plane and the patch antenna is partially filled with the dielectric material and partially filled with air.

5. The antenna system of claim 1, further comprising:

a parasitic patch arranged parallel to the ground plane such that the patch antenna is disposed between the parasitic patch and the ground plane.

6. The antenna system of claim 5, wherein the feed system does not supply RF signals directly to the parasitic patch.

7. The antenna system of claim 5, further comprising:

a dielectric material disposed between the patch antenna and the parasitic patch such that a space between the patch antenna and the parasitic patch is partially filled with the dielectric material and partially filled with air.

8. The antenna system of claim 1, wherein the patch antenna and the monopole antenna are configured to operate at S-band.

9. The antenna system of claim 1, wherein the composite antenna beam pattern of the antenna system has a substantially circular polarization in a propagation direction perpendicular to the ground plane and has a decreasingly circular polarization and an increasingly linear polarization with propagation at increasing angles to the perpendicular direction.

10. The antenna system of claim 1, wherein the composite antenna beam pattern of the antenna system is substantially symmetric about an axis perpendicular to the ground plane.

11. The antenna system of claim 1, further comprising:

a second patch antenna arranged parallel to the ground plane such that the patch antenna is disposed between the second patch antenna and the ground plane, wherein the RF signal includes both a component at the first frequency in a first frequency band and a component at a second frequency in a second frequency band that is different from the first frequency band, and wherein the feed system is configured to supply the second portion of the RF signal to the second patch antenna with a substantially circular polarization to produce a composite antenna beam pattern comprising both linear and substantially circular polarizations of the RF signal in both of the first and second frequency bands.

12. The antenna system of claim 11, wherein the first frequency band is S-band and the second frequency band is L-band.

13. The antenna system of claim 11, further comprising:

a dielectric material disposed between the patch antenna and the second patch antenna such that a space between the patch antenna and the second patch antenna is partially filled with the dielectric material and partially filled with air.

14. The antenna system of claim 1, wherein the patch antenna is a substantially planar, rectangular half-wave patch antenna.

15. The antenna system of claim 1, wherein the feed system comprises:

a directional coupler configured to split the RF signal into the first and second portions, the first portion having a greater power than the second portion;

a monopole feed configured to couple the first portion of the RF signal to the monopole antenna;

a 90° hybrid configured to split the second portion of the RF signal into first and second patch signals that are substantially equal in power and offset in phase by substantially 90°; and first and second patch feeds configured to respectively couple the first and second patch signals to the patch antenna to produce the substantially circular polarization.

16. The antenna system of claim 15, wherein:

the first patch feed is configured to couple the first patch signal to the patch antenna along a first axis in a plane of the patch antenna; and the second patch feed is configure to couple the second patch signal to the patch antenna along a second axis in the plane of the patch antenna, the second axis being perpendicular to the first axis.

17. The antenna system of claim 15, wherein the monopole feed supplies the first portion of the RF signal to an end of the monopole antenna adjacent to a center of the ground plane.

18. The antenna system of claim 15, wherein the monopole feed and the first and second patch feeds comprise coaxial connectors.

19. The antenna system of claim 1, wherein an area of the ground plane is at least twice as larger as an area of the patch antenna.

20. The antenna system of claim 1, wherein the ground plane is a ground plane of a circuit board.

* * * * *